United States Patent [19]

Sanders

[11] 4,338,751

[45] Jul. 13, 1982

[54] KNOCKDOWN SPIRAL STAIRWAY

[76] Inventor: Forest E. Sanders, 210 Pershing St., Green City, Mo. 63545

[21] Appl. No.: 173,458

[22] Filed: Jul. 30, 1980

[51] Int. Cl.[3] ..... E04F 11/00

[52] U.S. Cl. ..... 52/187

[58] Field of Search ..... 52/187, 184; 182/100

[56] References Cited

U.S. PATENT DOCUMENTS

| | | | |
|---|---|---|---|
| 384,376 | 6/1888 | McMullin | 52/187 X |
| 432,599 | 7/1890 | Clarke . | |
| 1,229,482 | 6/1917 | Leclair . | |
| 3,740,906 | 6/1973 | Schneider | 52/187 |
| 3,894,614 | 7/1975 | Naka | 52/187 X |
| 3,916,591 | 11/1975 | Agterhof et al. | 52/187 |
| 3,964,222 | 6/1976 | Geleijnse et al. | 52/187 |
| 4,190,992 | 3/1980 | Takenaga | 52/187 |

FOREIGN PATENT DOCUMENTS

| | | | |
|---|---|---|---|
| 2263156 | 6/1974 | Fed. Rep. of Germany | 52/187 |

*Primary Examiner*—Carl D. Friedman
*Attorney, Agent, or Firm*—Morton S. Adler

[57] ABSTRACT

A spiral stairway construction, designed for ease of assembly, is adapted for use by hobbists on a reduced scale, for display in model homes and elsewhere and for a spiral stairway installation in residences and the like. This stairway comprises a semicircular wall, a central vertical post support assembly and a plurality of treads or steps each diverging from its mounting or proximal end to its distal end as is usual in spiral stairway treads. Each proximal end has a mounting hole for removable attachment to the post support assembly in a vertically spaced relationshiped provided by spacing alignment on such support and each distal end is removably engaged with a designated point on the wall to dispose the treads in a helical path. The assembled construction is free standing and does not require anchoring the wall or post support assembly to any supporting surface.

4 Claims, 10 Drawing Figures

FIG. 10
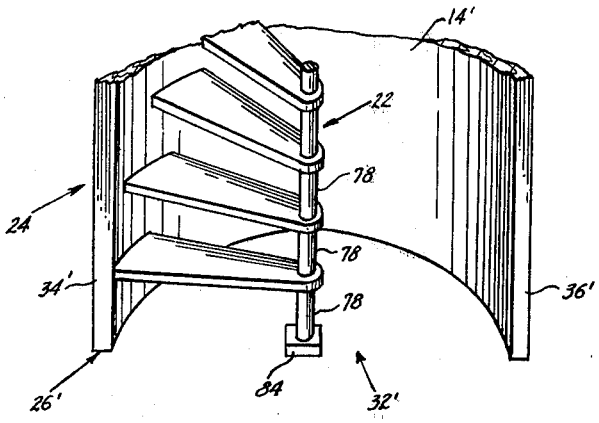
FIG. 8
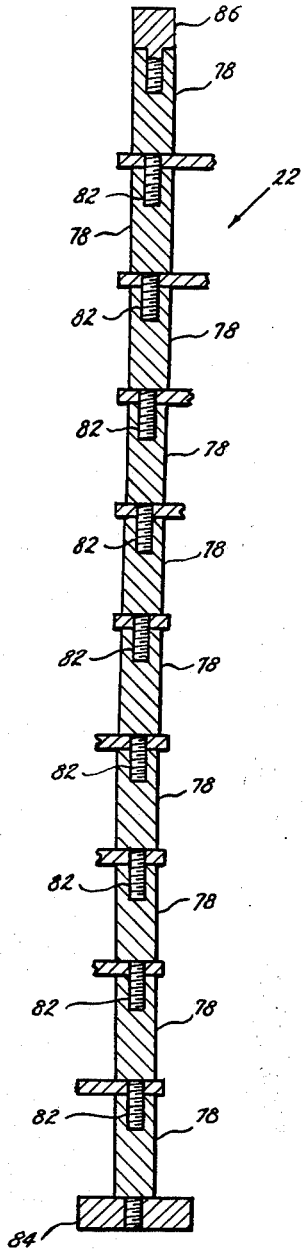
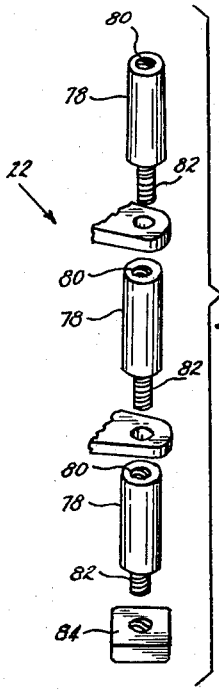
FIG. 9

KNOCKDOWN SPIRAL STAIRWAY

BACKGROUND OF THE INVENTION

This invention relates to spiral stairways and more particularly to a novel knockdown spiral stairway construction.

Many and varied forms of spiral stairways for residences and the like have been devised as exemplified in U.S. Pat. Nos. 432,599, 1,229,482, 3,418,770, 3,740,906 and 4,190,992 and notwithstanding certain endeavors to fabricate the various components to facilitate the actual installation, the disclosed installation procedures requiring the use of screws, bolts, welding and other fastening means are indicative of the permanency traditionally intended and inherent in such installations. In the present invention, it is one of the important objects to provide a spiral stairway construction that can be easily assembled into a sturdy free standing installation without any special skills and which can be easily disassembled.

Another object is to provide a spiral stairway construction of the above class that is designed for manufacture either on a reduced scale for use by hobbists, as for example, in miniature houses, or on a full scale for installation in residences and the like.

A further object herein is to provide a spiral stairway construction as characterized which at full scale is sturdy and safe when installed to serve as a permanent installation, if desired, but which can be easily disassembled and re-used such as for display purposes in model homes and other exhibitions.

In accordance with the present invention, there is provided a semicircular wall and a central vertical post support assembly together with a plurality of steps of usual spiral step design. The mounting or proximal end of the steps has a mounting hole by which the steps are aligned and secured to the post support assembly with spacer members forming a part of such assembly for proper vertical spacing of the steps. The distal end of each step is removably engaged in respective wall slots arranged to dispose the steps in a helical path. The post assembly for a reduced scale stairway preferably comprises a single rod with spacer sleeves and for full scale stairways, installation is facilitated by the use of a post support assembly comprising a predetermined number of removably longitudinally aligned post or rod lengths serving to secure the steps in appropriate alignment and spacing.

The foregoing objects and such further objects as may appear herein, or be hereinafter pointed out, together with the advantages of this invention will be more fully discussed and developed in the more detailed description of the accompanying drawings.

BRIEF DESCRIPTION OF THE DRAWINGS

FIG. 8 is a longitudinal sectional view showing a second embodiment of the post support assembly, FIG. 9 is a fragmentary exploded perspective of the post support assembly shown in FIG. 8, and FIG. 10 is a fragmentary perspective view of an assembled stairway using the post support assembly shown in FIGS. 8 and 9.

DESCRIPTION OF THE PREFERRED EMBODIMENTS

Figure 1:
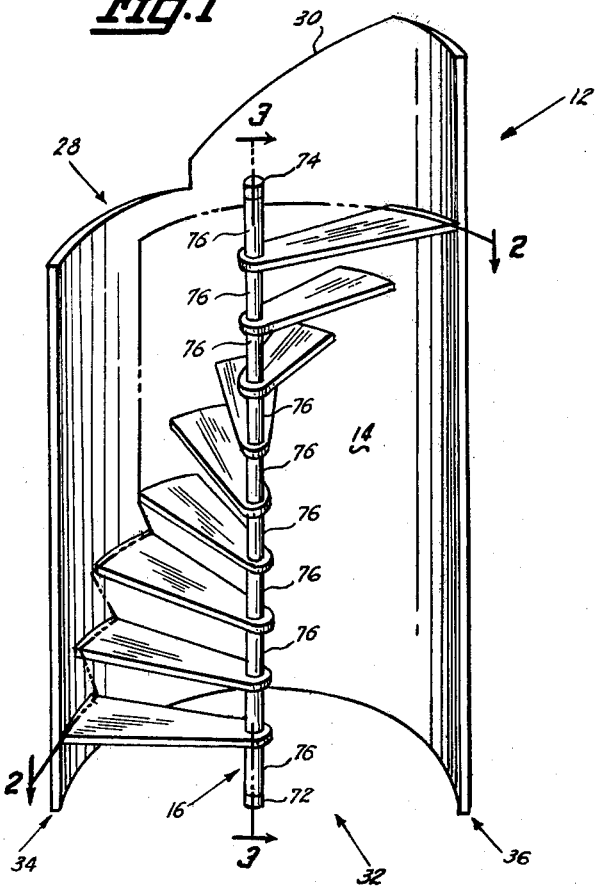
FIG. 1 is a perspective view of an assembled knockdown spiral stairway construction according to the present invention.

Referring to the drawings, this knockdown spiral stairway construction is designated generally by the numeral 12 as seen in erected position in FIG. 1 and comprises, in general, an arcuate and preferably semicircular outer wall 14, a central post support assembly 16 (FIG. 3) and two selective forms of step construction 18 and 20 shown respectively in FIGS. 6 and 7 for which more details will be described below. A second embodiment of a post support assembly 22 is shown in FIGS. 8 and 9 and applied to stairway 24 in FIG. 10. This stairway construction is designed for use on a reduced scale where it can be used to advantage by hobbists in miniature homes and the like and also for full scale construction for use in residences in a permanent installation, if desired, or for assembly and disassembly for display in model homes and other exhibitions and the two post support assemblies 16, 22 have advantages in the assembly and disassembly of this stairway in different environments that will become apparent as this description proceeds.

Figure 5:
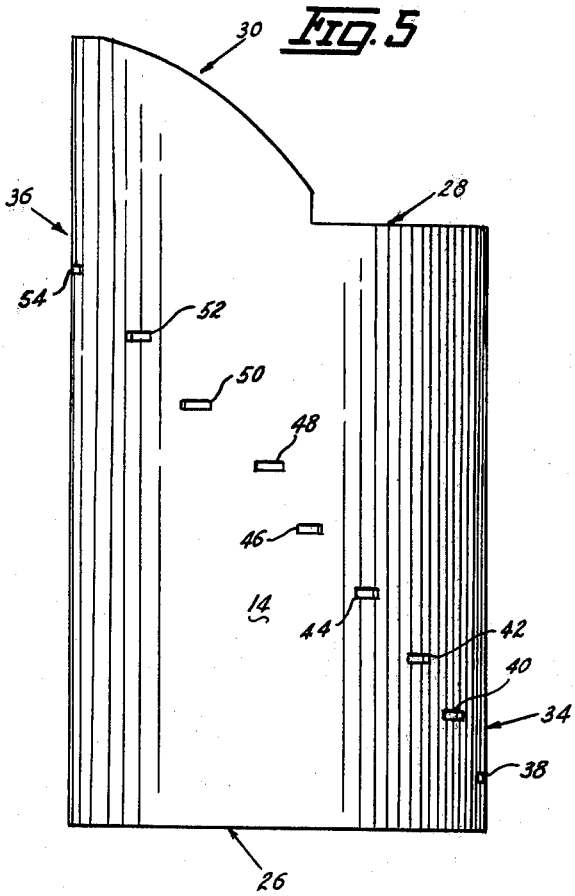
FIG. 5 is an elevational view of the outer side of the stairway wall.

Wall 14 has a planar bottom end 26 for placement on a supporting surface (not shown) and a top end 28 designed to extend vertically from end 26 to the ascending floor level which the stairway is intended to reach. Such top end 28 may have an extended rising portion 30 to carry a handrail (not shown) above the ascending floor level but this is not required as a part of this invention. The front 32 of stairway 12 is defined by the spaced wall edges 34, 36 and the arcuate wall 14 is provided with a plurality of slots represented at 38, 40, 42, 44, 48, 50, 52 and 54 are vertically spaced and angularly offset from the lowermost slot 38 spaced above the bottom end 26 adjacent edge 34 to the uppermost slot 54 spaced below the top end 28 at edge 36 as best seen in FIG. 5 and it will be understood that the number of such slots required may vary with the height of the stairway and the spacing of the several steps as may be desired.

Figure 6:
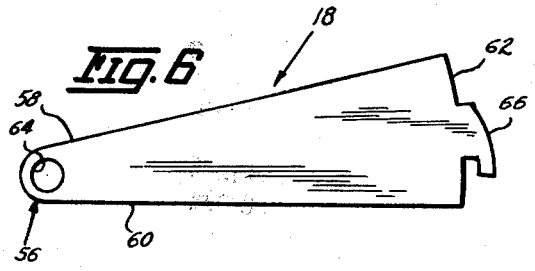
FIG. 6 is plan view showing one form of step construction used in this invention.
Figure 7:
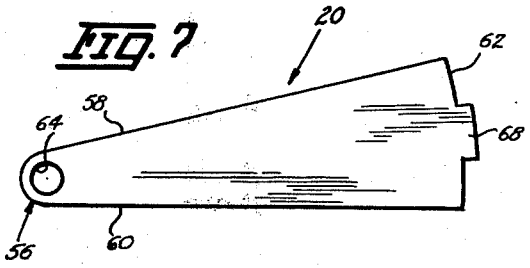
FIG. 7 is plan view showing another form of step construction used in this invention.

With reference to FIGS. 6 and 7, step members 18, 20 each comprise the proximal end 56 from which respective sides 58, 60 diverge to the distal end 62 forming a general wedge shaped tread surface as is usual in spiral stairsteps. A mounting hole 64 is provided at the proximal end 56 of each step with a projecting integral hook 66 on the distal end 62 of step 18 and projecting integral boss or lug 68 on the distal end 62 of step 20. Steps 18 and 20, as will be later pointed out in more detail, may be used separately or in combination in the installation of this stairway.

Figure 3:
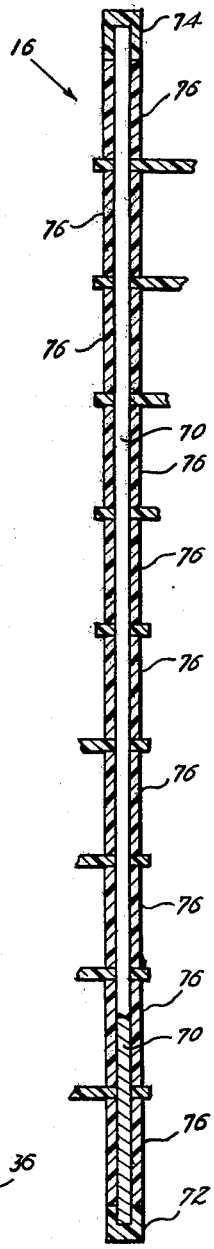
FIG. 3 is a cross sectional view taken on the line 3—3 of FIG. 1 showing one form of a post support assembly.
Figure 4:
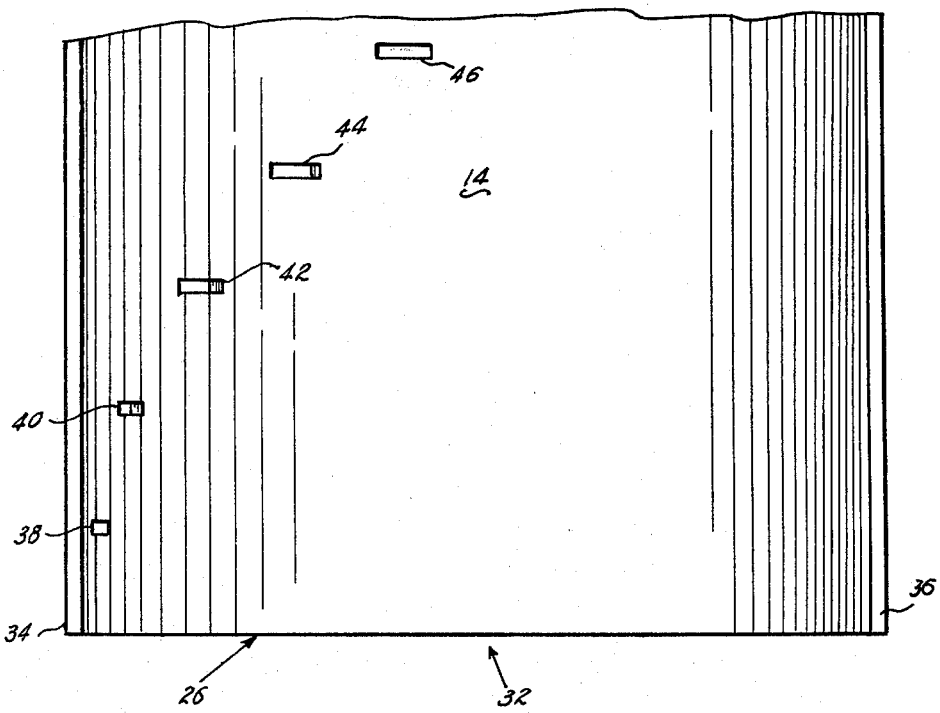
FIG. 4 is a fragmentary elevational view of the inner side of the stairway wall.

The central post support assembly used with this invention may be in the form shown at 16 in FIG. 3 which includes the elongated rod or post 70 having the lower cap 72 and the upper cap 74 and a plurality of spacer sleeves 76 for mounting on post 70 as shown or may be in the form shown at 22 in FIG. 8 where such support comprises a plurality of predetermined rod lengths each provided with a threaded recess 80 on one end and a threaded shank 82 on the other end whereby such rod lengths 78 can be secured in longitudinal alignment into an elongated rod or post supporting means as shown which, in effect, forms a solid support similarly to post 70. A lower cap 84 and an upper cap 86 is provided on assembly 22 as shown.

Figure 2:
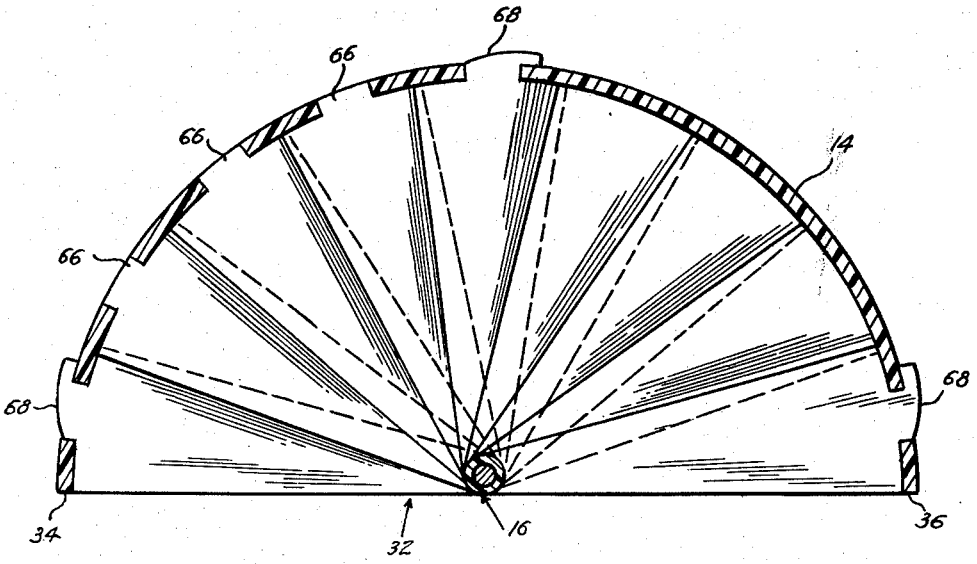
FIG. 2 is a cross sectional view taken on the line 2—2 of FIG. 1.

In the erection or installation of this stairway, the number of steps 18 or 20, or a combination of the two, will, of course, be equal to the number of slots in wall 14. The distal end 62 of each step is first seated in or placed in hooked engagement with a respective slot in wall 14 so that the distal ends 62 abut the inner surface of wall 14, lug 68 on step 20 extends to the outer surface of the wall and hook 66 on step 18 extends beyond the outer wall surface for engagement therewith as best seen in FIG. 2. The proximal ends 56 are then disposed so that the mounting holes 64 are vertically aligned to receive the mounting post assembly. It will be appreciated that this order of assembly is required by the fact that the axis of the mounting holes 64 corresponds to the axis of the post support assembly so that such support cannot be put into place until the mounting holes 64 are in registration. Accordingly, when the post support assembly is in place, the steps are effectively locked to wall 14 and, without removal of the post support, no step can be removed because of the diverse directions of the respective steps and the resulting opposing resistance forces through the post support assembly to the removal of any one of them. By this arrangement, the stairway is rigid and sturdy and with the bottom of the wall and the bottom of the post supporting assembly engaging the supporting surface, the assembled structure is free standing and it is not necessary to anchor the wall or post supporting assembly to such surface.

As indicated above, this stairway is designed for use on both a reduced scale for hobbists in miniature buildings, for example, and on a full scale for actual use or exhibition, and I will now describe in more detail the use of post support assemblies 16, 22 relative thereto.

For purposes of illustration, the stairway 12 shown in FIG. 1 may be deemed to represent a reduced scale construction as for example, on the order of nine to twelve inches in height. In such instances for practical purposes, it can be expected that the thickness of wall 14 would be relatively thin, perhaps on the order of one eight inch more or less which has been the case with actual reduced scale stairways constructed of Plexiglass although the material used is a matter of choice. Since such a reduced model is easily handled, post support assembly 16 can be used with facility. In this situation, wall 14 can be held in the hands or laid upon its back and rod 70, with the proximal ends 56 of the steps aligned after positioning the distal ends as described, can be inserted through the mounting holes 64 from either the top or bottom ends 26, 26 with, of course, spacers 76 being journalled on rod 70 intermediate adjacent steps and caps 72, 74 applied as shown. Stairway 12 can then be placed where desired and disassembly is accomplished simply by reversing the installation procedure. Also, because of the relative thinness of wall 14 on a reduced scale construction, it is preferable that two or more steps 18 with the hook 66 be used as seen in FIG. 2 although this may not necessarily be required.

With reference now to FIGS. 8–10, stairway 24 shown in FIG. 10 may be deemed for purpose of illustration to represent a full scale construction in which like parts as described for stairway 12 are given like numerals primed. In this case it is apparent that wall 14' must be sturdy and, depending upon the material used, will have a thickness relatively greater than in a reduce scale so that the wall slots will offer an adequate support surface in which step 20 will be adequate although step 18 can also be used, if desired.

While it would be possible to use the single rod support assembly 16 (FIG. 3) for the full scale stairway 24 if space requirements for installation were available, there are obvious practical dificulties in doing so and these are eliminated by the use of assembly 22 (FIG. 8). Thus, wall 14' is first set in place since stairway 24, because of its size and weight, cannot conveniently be otherwise erected as described for stairway 12. Starting with the bottom cap 84 and lowermost rod length 78, the lowermost step is first mounted with its distal end engaged in wall 14 and the mounting hole 64 in its proximal end placed in registration with the top end of the rod length 78 just below. The next ascending rod length 78 is then secured through the mounting hole of said step to the next descending rod length 78 whereby such step is secured and with the rod length 78 also serving as the spacer means. This procedure is continued until all steps and rod lengths 78 with cap 86 are in place as shown to provide an effective, sturdy and safe stairway locked in place with free standing capability as described above. Disassembly is by reversing the steps of installation. Accordingly, in view of the foregoing, it is thought a full understanding of the construction and operation of this invention will be had and the advantages of the same will be appreciated.

I claim:

1. A spiral stairway construction, comprising:

an arcuate wall having a top end, a bottom end and defining first and second spaced wall edges each having an upper and lower end, said wall being vertically disposed with said bottom end adapted to rest on a supporting surface, said wall being provided with a plurality of slots that are vertically spaced and angularly offset from a predetermined point near the lower end of said first wall edge to a predetermined point near the upper end of said second wall edge to define a helical path, a plurality of individual steps each having a proximal end from which respective sides diverge to a distal end forming a tread surface of usual spiral stairstep design, the proximal end of each step provided with a mounting hole, a hook member on the distal end of each step affording removable engagement of each respective distal end with said wall through a respective slot, with said distal ends engaged in a respective wall slot the proximal end of each step extending to a point intermediate said first and second wall edges with said mounting holes disposed in vertically aligned registration, a post support means removably journalled through said aligned holes to engage the supporting surface whereby the assembled stairway is free standing with said steps effectively locked in position to said wall and cannot be displaced without removal of said post support means, and means on said post support means for effectively spacing adjacent steps.

2. A spiral stairway construction, comprising:

an arcuate wall having a top end, a bottom end and defining first and second spaced wall edges each having an upper and lower end, said wall being vertically disposed with said bottom end adapted to rest on a supporting surface, said wall being provided with a plurality of slots that are vertically spaced and angularly offset from a predetermined point near the lower end of said first wall edge to a predetermined point near the upper end of said second wall edge to define a helical path, a plurality of individual steps each having a proximal end from which respective side diverge to a distal end forming a tread surface of usual spiral stairstep design, the proximal end of each step provided with a mounting hole, the distal end of a selected number of steps being provided with a projecting boss for seating in a selected slot in said wall, the distal end of the remaining steps being provided with a hook member for hooked engagement with said wall through other selected slots, with said distal ends engaged in a respective wall slot the proximal end of each step extending to a point intermediate said first and second wall edges with said mounting holes disposed in vertically aligned registration, a post support means removably journalled through said aligned holes to engage the supporting surface whereby the assembled stairway is free standing with said steps effectively locked in position to said wall and cannot be displaced without removal of said post support means, and means on said post support means for effectively spacing adjacent steps.

3. A spiral stairway construction as defined in claims 1, or 2 wherein said post support and spacer means comprises:

an elongated rod member removably journalled through said aligned mounting holes, and respective spacer sleeves removably journalled on said rod member intermediate adjacent steps.

4. A spiral stairway construction as defined in claims 1, or 2 wherein said post support and spacer means comprises:

a plurality of rod lengths adapted to be removably connected in longitudinal alignment to form a unitary post support of indeterminate lenth, the proximal end of each respective step being disposed intermediate and secured by the respective abutting ends of respective attached rod lengths, and said rod lengths serving also as spacer means for adjacent steps.

* * * * *

REEXAMINATION CERTIFICATE (276th)

United States Patent [19] [11] B1 4,338,751

Sanders [45] Certificate Issued Nov. 20, 1984

[54] KNOCKDOWN SPIRAL STAIRWAY

[76] Inventor: Forest E. Sanders, 210 Pershing St., Green City, Mo. 63545

Reexamination Request:
No. 90/000,394, Jun. 10, 1983

Reexamination Certificate for:

| | |
|---|---|
| Patent No.: | **4,338,751** |
| Issued: | **Jul. 13, 1982** |
| Appl. No.: | **173,458** |
| Filed: | **Jul. 30, 1980** |

[51] Int. Cl.[3] ..... E04F 11/00
[52] U.S. Cl. ..... 52/187
[58] Field of Search ..... 52/182, 184, 187, 188, 52/191; 182/48, 49

[56] References Cited

U.S. PATENT DOCUMENTS

| | | | |
|---|---|---|---|
| 111,610 | 2/1871 | Close | 52/187 X |
| 384,376 | 6/1888 | McMullin | 52/187 |
| 1,002,142 | 8/1911 | Flagg | 52/184 |
| 1,075,156 | 10/1913 | Nesdall | 52/191 |
| 1,474,850 | 11/1923 | Rudloff | 52/191 |
| 1,676,317 | 7/1928 | Bennett | 52/191 X |
| 1,799,405 | 4/1931 | Bois | 52/184 X |
| 1,867,374 | 7/1932 | Myers | 46/21 |
| 3,751,848 | 8/1973 | Ahlstrand | 46/21 |
| 3,916,591 | 11/1975 | Agterhof et al. | 52/187 |

FOREIGN PATENT DOCUMENTS

| | | | |
|---|---|---|---|
| 801857 | 1/1951 | Fed. Rep. of Germany | 52/188 |
| 2263156 | 6/1974 | Fed. Rep. of Germany | 52/187 |
| 2503060 | 7/1976 | Fed. Rep. of Germany | 52/187 |
| 2316409 | 1/1977 | France | 52/187 |
| 1405981 | 9/1975 | United Kingdom | 46/21 |

*Primary Examiner*—Alfred C. Perham

[57] ABSTRACT

A spiral stairway construction, designed for ease of assembly, is adapted for use by hobbists on a reduced scale, for display in model homes and elsewhere and for a spiral stairway installation in residences and the like. This stairway comprises a semicircular wall, a central vertical post support assembly and a plurality of treads or steps each diverging from its mounting or proximal end to its distal end as is usual in spiral stairway treads. Each proximal end has a mounting hole for removable attachment to the post support assembly in a vertically spaced relationshiped provided by spacing alignment on such support and each distal end is removably engaged with a designated point on the wall to dispose the treads in a helical path. The assembled construction is free standing and does not require anchoring the wall or post support assembly to any supporting surface.

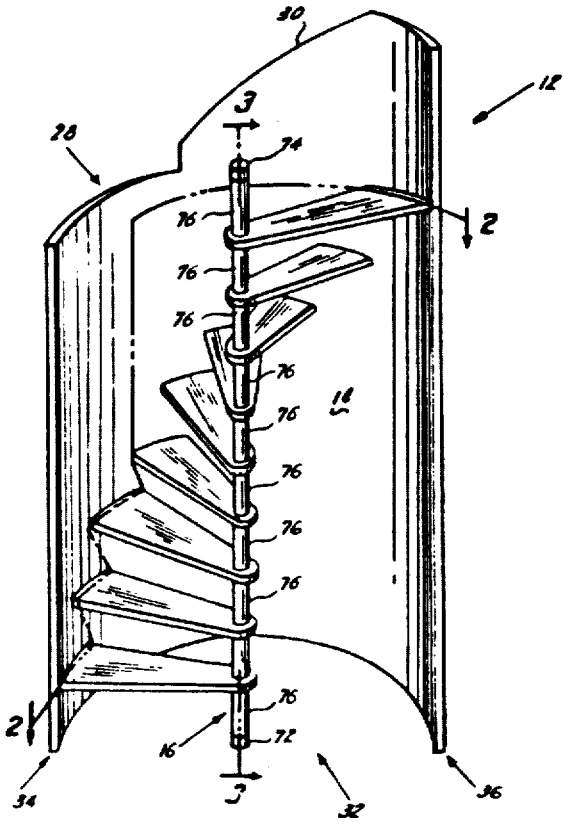

REEXAMINATION CERTIFICATE ISSUED UNDER 35 U.S.C. 307.

THE PATENT IS HEREBY AMENDED AS INDICATED BELOW.

AS A RESULT OF REEXAMINATION, IT HAS BEEN DETERMINED THAT:

Claims 1-4 are cancelled.

* * * * *